US008772617B1

(12) United States Patent
McGee et al.

(10) Patent No.: US 8,772,617 B1
(45) Date of Patent: Jul. 8, 2014

(54) DRUM TUNER

(71) Applicants: Michael Dale McGee, Oakland, CA (US); Peter Anthony Franco, Pacifica, CA (US)

(72) Inventors: Michael Dale McGee, Oakland, CA (US); Peter Anthony Franco, Pacifica, CA (US)

( * ) Notice: Subject to any disclaimer, the term of this patent is extended or adjusted under 35 U.S.C. 154(b) by 0 days.

(21) Appl. No.: 13/754,902

(22) Filed: Jan. 31, 2013

Related U.S. Application Data

(60) Provisional application No. 61/739,713, filed on Dec. 19, 2012.

(51) Int. Cl.
*G10D 7/00* (2006.01)
*G10D 13/02* (2006.01)

(52) U.S. Cl.
CPC ..... *G10D 13/023* (2013.01)
USPC ..... 84/458; 84/413

(58) Field of Classification Search
CPC ..... G10D 13/023
USPC ..... 84/458, 413
See application file for complete search history.

(56) References Cited

U.S. PATENT DOCUMENTS

| | | | | | |
|---|---|---|---|---|---|
| 769,527 | A * | 9/1904 | Bahr | 84/411 R |
| 2,729,133 | A * | 1/1956 | Ludwig | 84/419 |
| 4,122,749 | A * | 10/1978 | Hoellerich | 84/419 |
| 4,287,806 | A * | 9/1981 | Neary | 84/458 |
| 4,453,448 | A * | 6/1984 | Miesak | 84/454 |
| 4,635,524 | A * | 1/1987 | Allen et al. | 84/419 |
| 4,741,242 | A * | 5/1988 | Aronstein | 84/454 |
| 4,909,125 | A * | 3/1990 | Fece | 84/411 A |
| 5,157,212 | A * | 10/1992 | Fleming | 84/413 |
| 5,394,775 | A * | 3/1995 | Fagerstrom | 81/479 |
| 5,487,320 | A * | 1/1996 | De Mowbray | 84/413 |
| 5,770,810 | A * | 6/1998 | Lombardi | 84/411 R |
| 5,977,463 | A * | 11/1999 | Bartlett | 84/413 |
| 6,043,421 | A * | 3/2000 | Adams | 84/419 |
| 6,812,392 | B2 * | 11/2004 | Brando | 84/411 R |
| 6,925,880 | B1 * | 8/2005 | Roberts | 73/587 |
| 7,495,161 | B1 * | 2/2009 | Richards | 84/411 R |
| 8,008,560 | B2 * | 8/2011 | Wiese et al. | 84/411 R |
| 8,203,063 | B2 * | 6/2012 | Truda | 84/411 R |
| 8,283,544 | B2 * | 10/2012 | Zuffante et al. | 84/454 |
| 8,502,060 | B2 * | 8/2013 | Ribner | 84/616 |
| 8,642,867 | B1 * | 2/2014 | Bedson | 84/413 |
| 8,642,874 | B2 * | 2/2014 | Ribner | 84/616 |
| 2007/0084328 | A1 * | 4/2007 | Kashioka | 84/413 |
| 2011/0252943 | A1 * | 10/2011 | Zuffante et al. | 84/413 |
| 2012/0017745 | A1 * | 1/2012 | Truda | 84/413 |

* cited by examiner

*Primary Examiner* — Robert W Horn
(74) *Attorney, Agent, or Firm* — Ecotech Law Group, P.C.

(57) ABSTRACT

A drum tuner is described. The drum tuner includes: (i) a hub gear; (ii) two or more differential gears communicatively coupled to the hub gear and at least one of the two or more differential gears capable of engaging a tuning mechanism of a drum; and (iii) wherein, during an operational state of the drum tuner, rotation of the hub gear rotates at least one of the two or more differential gears to activate the drum's tuning mechanism.

27 Claims, 9 Drawing Sheets

DRUM TUNER

RELATED APPLICATION DATA

The present application claims benefit, pursuant to the provisions of 35 U.S.C. §119, of U.S. Provisional Application Ser. No. 61/739,713, naming Michael Dale McGee and Peter Anthony Franco as inventors, and filed Dec. 19, 2012, the entirety of which is incorporated herein by reference for all purposes.

The present invention relates to a drum tuner. More particularly, the present invention relates to a drum tuner that engages with more than one drum tuning mechanism at the same time.

BACKGROUND

A drum has a drumhead that is secured around its periphery by a rim. The rim is tightly fastened around the drum's periphery by a plurality of tuning mechanisms disposed around the drum. A drum tuning mechanism includes a lug. During a drum's tuning process, the lug's rotational displacement typically tightens the drumhead. Commonly a drum key engages with a single lug to produce the requisite rotational displacement during tuning. When the drumhead is to be replaced, the drum key is used to loosen the lugs, one lug at a time.

SUMMARY

In view of the foregoing, the present teachings provide drum tuner configurations and methods of using the same that allow tuning of two or more drum tuning mechanism by applying torque at a single location. Drum tuners of the present teachings may also be used to remove a drumhead from a drum.

In one aspect, the present teachings provide a drum tuner. The drum tuner includes: (i) a hub gear; (ii) two or more differential gears communicatively coupled to the hub gear and at least one of the two or more differential gears are capable of engaging a tuning mechanism of a drum; and (iii) wherein, during an operational state of the drum tuner, rotation of the hub gear rotates at least one of the two or more differential gears to activate the drum's tuning mechanism.

In one embodiment, a crank sub-assembly preferably drives the hub gear of the present teaching. In accordance with one embodiment of the present teaching, the crank sub-assembly includes: (i) at least two crank gears; (ii) a stage gear having a portion coupled to one of the at least two crank gears such that a rotation of one of the at least two crank gears rotates the stage gear; (iii) a crank pinion meshing with another of at least two of the crank gears such that rotation of the crank pinion rotates another of at least two of the crank gears that is coupled to a hub shaft, and (iii) wherein another of the at least two crank gears is coupled to a hub shaft that is in turn coupled to the hub gear such that rotation of another of the at least two crank gears through the hub shaft rotates the hub gear and the crank pinion is coupled to crank shaft, which is capable of rotation by action of an electrical motor or by manually rotating the crank shaft using a handle.

In one preferred aspect, an electrical motor drives the hub gear. In one embodiment, at least one of the two or more differential gears is secured inside a tuning yoke that is capable of lateral displacement along an arm sub-assembly so that the drum tuner is capable of tuning a plurality of drums of different sizes. The drum tuner may further include two or more arm sub-assemblies, and at least one of the two or more arm sub-assemblies is disposed between the hub gear and at least one of the two or more differential gears, wherein, during an operational state of the drum tuner, rotation of the hub gear rotates at least one of the two or more arm sub-assemblies, which in turn rotates at least one of the two or more differential gears. In one embodiment, a number of arm sub-assemblies in the present drum tuner ranges from 1 to 20, and preferably ranges from 2 to 20.

At least one of the two or more arm sub-assemblies includes an inner arm component and an outer arm component and a clutch mechanism connects the inner arm component and the outer arm component such that rotation in a first direction of the inner arm component rotates the outer arm component until a predetermined potential energy value is achieved at the clutch mechanism, and when rotational displacement in the first direction of the inner arm component exceeds the predetermined potential energy value at the clutch mechanism, rotation of the outer arm component ceases.

The displacement in a second direction of the inner arm component may rotate the outer arm component in the second direction is opposite to the first direction. The first direction may be a clockwise direction and the second direction may be a counter-clockwise direction. In one aspect of the present teaching, at least one of the two or more arm sub-assemblies includes an arm gear that is meshed with the differential gear such that rotation of the arm gear rotates the differential gear. The arm gear may be a beveled gear.

In another aspect, the present teachings provide a clutch mechanism. The clutch mechanism includes: (i) a female clutch component; (ii) a male clutch component capable of engaging with the female clutch component; (iii) a shaft designed to transfer torque at the female clutch component to a differential gear capable of engaging with a drum's tuning mechanism; (iv) a disengaging mechanism that is designed to cause the male clutch component to disengage with the female clutch component when a predetermined potential energy value is achieved at the disengaging mechanism; and (v) wherein the predetermined potential energy value is reached at the disengaging mechanism after repeated rotation in a first direction (e.g., clockwise direction) of the male clutch component and the female clutch component.

At least a portion of the male clutch component engages with a portion of the female clutch component at an angle that may range from about 35° to about 50°. At least a portion of the male clutch component may engage with a portion of the female clutch component at an angle of about 45°. The disengaging mechanism preferably in eludes a spring and a stopper such that the spring stores potential energy produced from rotation of the female clutch component. Furthermore, when the potential energy stored inside the spring reaches the predetermined potential energy value, then preferably the stopper prevents rotation of the female clutch component in response to rotation of the male clutch component. By way of example, the stopper is a nut.

In yet another aspect, the present teachings provide a process of tuning a drum. The process includes: (i) engaging two or more tuning mechanisms of the drum with two or more differential gears that are communicatively coupled to a hub gear; (ii) inducing torque at the hub gear; and (iii) transferring torque at the hub gear to two or more of the differential gears.

The process of tuning the drum may further include: (i) producing potential energy proximate to a first location associated with one of the two or more differential gears during transferring torque; (ii) storing potential energy at the first proximate location associated with one of the two or more differential gears; and (iii) ceasing transfer of torque from the hub gear to one of the two or more differential gears when potential energy stored at the first proximate location associated with one of the two or more differential gears reaches or exceeds a predetermined potential energy value.

The process of tuning of the drum may further still include: (i) continuing inducement of torque at the hub gear after ceasing transfer of torque from the hub gear to one of the two or more differential gears until potential energy produced at a second proximate location associated with another of the two or more differential gears reaches or exceeds the predetermined potential energy value.

According to one embodiment of the present teaching, the process of tuning the drum may further include: (i) continuing inducement of torque at the hub gear after ceasing transfer of torque from the hub gear to one of the two or more differential gears until potential energy produced at each proximate location associated with each of the two or more differential gears reaches or exceeds the predetermined potential energy value. The torque at two or more of the differential gears may be clockwise.

In yet another aspect, the present teachings provide a process of removing a drumhead. The process includes: (i) engaging two or more tuning mechanisms of the drum with two or more differential gears that are communicatively coupled to a hub gear; (ii) inducing torque at the hub gear; and (iii) transferring torque at the hub gear to two or more of the differential gears. In this process, the torque at two or more of the differential gears may be counter-clockwise. In a preferred embodiment of the present teaching, at least one of the two or more differential gears is magnetic.

DETAILED DESCRIPTION

In the following description, numerous specific details are set forth in order to provide a thorough understanding of the present invention. It will be apparent, however, to one skilled in the art that the present invention may be practiced without limitation to some or all of these specific details. In other instances, certain well-known process steps may not have been described in detail in order to not unnecessarily obscure the invention.

According to one preferred configuration of the present arrangement, a drum tuner includes a hub gear and two or more differential gears. In this configuration, the two or more of the differential gears are communicatively coupled to the hub gear. Furthermore, at least one of the two or more differential gears is capable of engaging with a tuning mechanism of the drum (e.g., a lug). During an operational state of the present drum tuner, rotation of the hub gear rotates at least one of the two or more differential gears to activate the drum's tuning mechanism. By way of example, rotation of the hub gear causes a plurality of differential gears to rotate and each differential gear, in turn, rotates a single lug during a tuning operation. In other words, according to this example, rotation of a single hub gear rotates a plurality of lugs at the same time during tuning.

Figure 1:
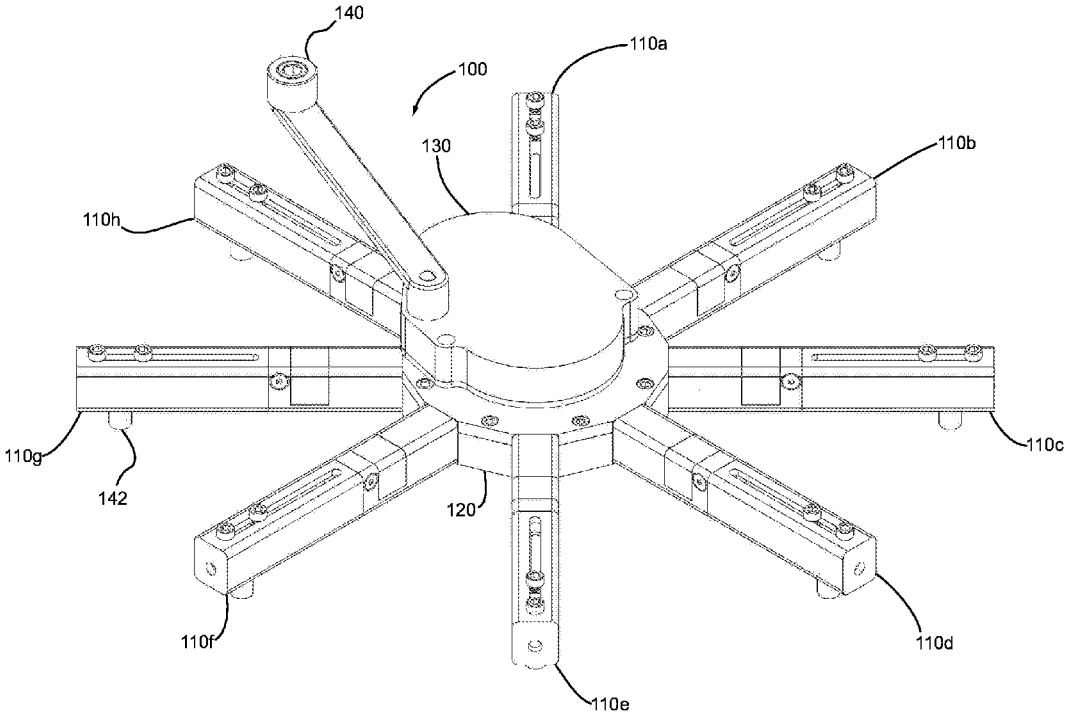
FIG. 1 shows a perspective view of the drum tuner, according to one present arrangement, showing arm sub-assemblies coupled to a hub component that is in turn coupled to a crank sub-assembly.

Two or more of the differential gears and the hub gear may be communicatively coupled in a variety of different ways. FIG. 1 shows one exemplar configuration of a drum tuner 100, in which a plurality of arm sub-assemblies are used to communicatively couple the hub gear to two or more of the differential gears.

According to the configuration of FIG. 1, drum tuner 100 includes a hub component 120 that has radially disposed around it a plurality of arm sub-assemblies 10*a*-10*h*. Each of arm sub-assemblies 10*a*-10*h* include a differential gear 145 (shown in greater detail in FIG. 3). Each differential gear 145 (see FIG. 3) is located on an underside at a distal end of its associated arm sub-assembly and is designed to engage with a drum's tuning mechanism. It is not necessary, however, for each arm sub-assembly to include a differential gear. Each of some arm assemblies may include a differential gear, while others may not.

In those instances where the drum's tuning mechanism is a lug, the differential gear's inner surface, which engages with the lug's outer surface, may have a contour that is complementary to the contour of the lug's outer surface for effective torque transfer from the differential gear to the lug. Furthermore, it is not necessary, but preferable, to employ the same number of arm sub-assemblies around hub component 120 as the number of lugs disposed around a drum. In certain present arrangements of a single drum tuner, the number of arm sub-assemblies range from 2 to 20.

As shown in FIG. 1, drum tuner 100 also includes a crank sub-assembly 130 disposed above hub component 120. It will be explained in connection with FIGS. 5, 6 and 7 that hub component 120 houses a hub gear and that torque generated by crank subassembly 130 using a handle 140, for example, or generated by an external electrical motor rotates the hub gear. It is important to note that to introduce torque at the hub gear, means other than crank sub-assembly 130 or an electrical motor may be used. By way of example, a drill driver or a cordless screw driver may well be used to induce torque at the hub gear.

Figure 2:
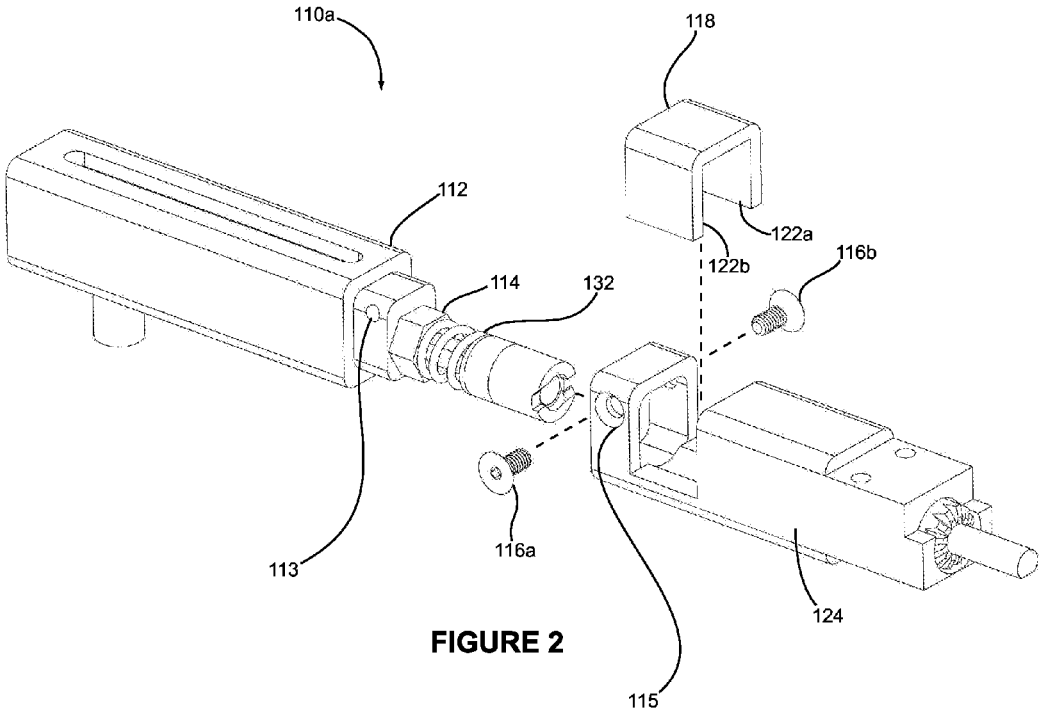
FIG. 2 shows a partially exploded perspective view of one exemplar arm sub-assembly, according to one present arrangement.
Figure 3:
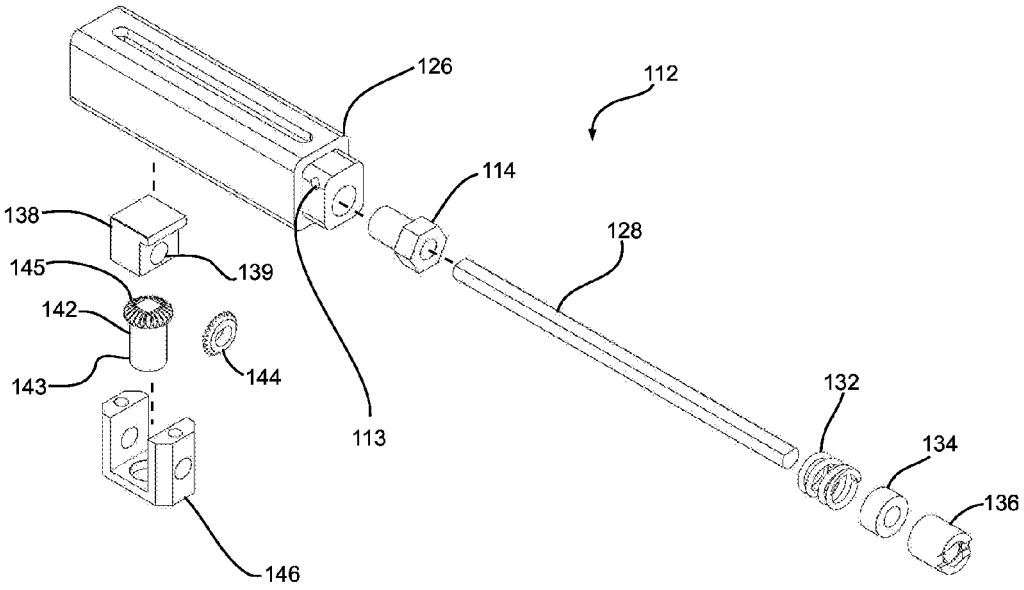
FIG. 3 shows an exploded perspective view of an outer arm component, according to one present arrangement, of the exemplar arm sub-assembly of FIG. 2.

FIG. 2 shows details of major components relevant in exemplar arm sub-assembly 110*a* of FIG. 1. According to this figure, arm sub-assembly 110*a* includes an inner arm component 124 and an outer arm component 112. Inner arm component 124 may be proximate the hub gear (see manner in which beveled hub gear 164 shown in FIG. 6 is preferably configured to mesh with inner gear 154 of FIG. 5). At distal end of arm sub-assembly 110*a* outer arm 112 may be disposed. As shown in FIG. 2, inner arm component 124 and outer arm component 112 are communicatively coupled by a clutch mechanism, which is shown and discussed in greater detail in FIG. 8. Those familiar with tuning drums will appreciate that it is sometimes preferable to have the capability of differentiating the tuning of one lug relative to another lug on the same drum. To this end, a clutch mechanism shown in FIGS. 2 and 3 is useful.

FIG. 2 shows components of the clutch mechanism, e.g., a stopper 114 and a potential energy storage component 132. Stopper 114 may be a nut and potential energy storage component may be a spring. Regardless of the components inside the clutch mechanism, FIG. 2 shows that a portion of the clutch mechanism is housed inside an arm cover 118. Arm cover 118 includes inner surfaces 122*a* and 122*b* which may be configured to interface with a hex head of stopper 114 (e.g., a nut) such that it immobilizes stopper 114 and/or the clutch mechanism in an assembled state of inner arm component 124 and outer arm component 112. An easily removable arm cover, such as the one shown in FIG. 2, allows access to components of the clutch mechanism, such as stopper 114 and/or potential energy storage component 132, to adjust the amount of potential energy stored inside the clutch mechanism. As will be explained later that it may be desirable to adjust the amount of potential energy stored inside the clutch mechanism to a predetermined value such that when the predetermined potential energy value is reached, the torque transferring mechanism cases to transfer torque to the drum's tuning mechanism. To this end, if the clutch mechanism is adjusted to store a smaller than the required amount of potential energy potential storage component 132, then the amount of tuning accomplished by the drum tuner may fall well short of the tuning typically accomplished during a coarse and/or fine tuning stage. On the other hand, if the clutch mechanism is adjusted to store a larger than the required amount of potential energy in potential storage component 132, then the amount of tuning accomplished by the drum tuner may far exceed the tuning typically accomplished during a coarse and/or fine tuning stage. As a result, arm cover 118 facilitates in providing settings for the clutch mechanism that ensures that a proper amount of tuning is accomplished by the present drum tuners.

It is important to note that arm cover 118 may be secured on inner arm component 124 in a number of different ways. Representative methods by which arm cover 118 may be secured on inner arm component 124 include using, e.g., snap, hook, hinge, pin, interference, slide, and adhesive. It is also noteworthy that the clutch mechanism and arm cover 118 as shown in FIGS. 2 and 3 may be provided on outer arm component 112, instead of being provided on inner arm component 124 as shown in FIG. 2.

Regardless of where the clutch mechanism and arm cover 118 are provided, in a communicatively coupled state of inner arm component 124 and outer arm component 112, a couple of fasteners 116*a* and 116*b* are secured inside apertures 115 defined in inner arm component 124 and inside apertures 113 defined in outer arm component 112.

In one present arrangement, it is not necessary to use a clutch mechanism to secure inner arm component 124 and outer arm component 112. According to the present teachings, it is possible to secure inner arm component 124 and outer arm component 112 using a number of different methods including any one of, for example, threading, interference fit, pin, snap ring, or a post operation such as adhesive, welding, or soldering.

FIG. 3 shows certain components of outer arm assembly 112. Outer arm housing 126, which may be obtained from at least one method chosen from a group including machining aluminum, manufacturing as an injection molded polymer and a die-casting aluminum. Outer arm assembly 112 includes an outer arm housing 126, stopper 114 (e.g., a nut), an outer arm shaft 128, a potential energy storing component (e.g., spring) 132, a bushing 134, a female clutch component 136. Outer arm shaft 128 extends into outer arm housing 126 and into or passes through an aperture 139 defined inside tuning bushing 138. At or near end of shaft 128 and inside housing 126, shaft 128 includes an outer arm gear 144. Outer arm gear 144 may be a beveled gear that is designed to mesh with differential gear 145 that is secured inside tuning yoke 146. In one present arrangement, tuning yoke 146, differential gear 145 and tuning bushing 138 are assembled to form a slidable tuning sub-assembly. Aided by pins (see FIGS. 1, 5 and 7), tuning bushing 138 may be capable of sliding along a rail inside housing 126 and may so slide along a length of housing 126. According to this arrangement, the location of the slidable tuning mechanism along a length of housing 126 may be adjusted such that a lug of any sized drum or bolt circle may be engaged by differential gear 145 for effective tuning.

In the drum tuner configuration of FIG. 3, tuning bushing 138 may be designed to ensure that outer arm gear 144 is properly aligned to the outer arm shaft 128 and to female clutch component 136. As explained above, rotation of female clutch component 136 rotates differential gear 145. In a preferred embodiment, female clutch component 136 is secured to shaft 128 ensuring that there is no relative rotational or translational freedom. This may be achieved using any number of different methods, including at least one chosen from a group including using mechanical means such as set screws, pins, interference fit, snap rings, adhesive, welding. In one embodiment, female clutch component 136 may be integrated with shaft 128. Shaft 128 may have a flat portion in order to better transmit torque through each component. The outer arm shaft may also use other means for transmitting torque, such as set screws, pins, welds, adhesive, or interference geometry. In some instances when it is desirable to adjust tension of female clutch component 136, potential energy storage component 132 and bushing 134 facilitate adjustment of the amount of potential energy stored when stopper 114 is turned. In this manner, the amount of potential energy stored during a tuning process is set to a predetermined level such that when that predetermined level is reached or exceeded, female clutch component 136 ceases to receive torque.

FIG. 3 shows that shaft 128 passes through stopper 114 and bushing 134 to couple with female clutch component 136. Potential energy storing component 132 is disposed around shaft 128 and between stopper 114 and bushing 134. As will be explained below, during an operational state of the present drum tuners, inner arm component 124 transfers torque from the hub gear to female clutch component 136. A rotating female clutch component, in turn, rotates shaft 128 that is coupled to it. Similarly, a rotating shaft 128 rotates outer arm gear 144 that is coupled to it. During this operation, differential gear 145, which is in meshing arrangement with outer arm gear 144, also rotates. In this manner, the torque from the hub gear is transferred to differential gear during a tuning operation. As mentioned above, a differential gear that contacts a drum's tuning mechanism activates the tuning process. In one preferred arrangement, at least an engaging portion of differential gear 145 that engages with the drum's tuning mechanism is made from a magnetic material to allow for effective engagement during the tuning process.

Figure 4:
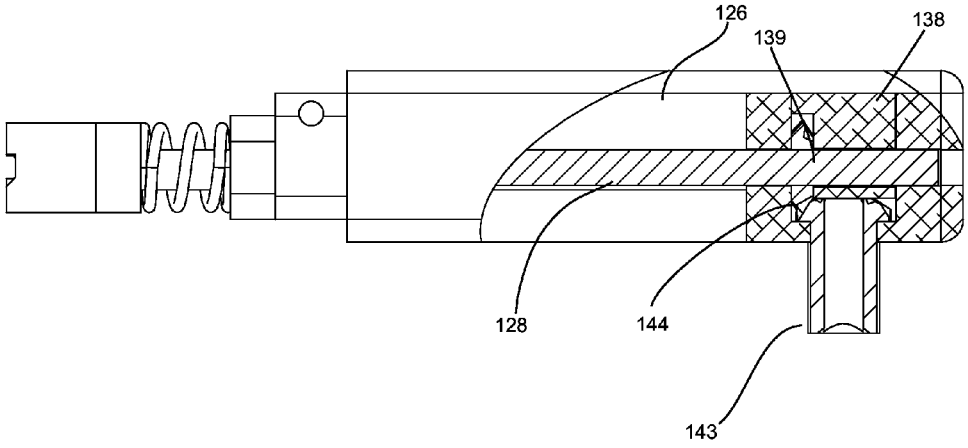
FIG. 4 shows a partially exposed side-view of the outer arm component of FIG. 3.

To facilitate illustration of, among other things, the coupling between tuning bushing 138 and shaft 128, FIG. 4 shows a partially exposed view of an assembled outer arm component 112 of FIG. 3.

Figure 5:
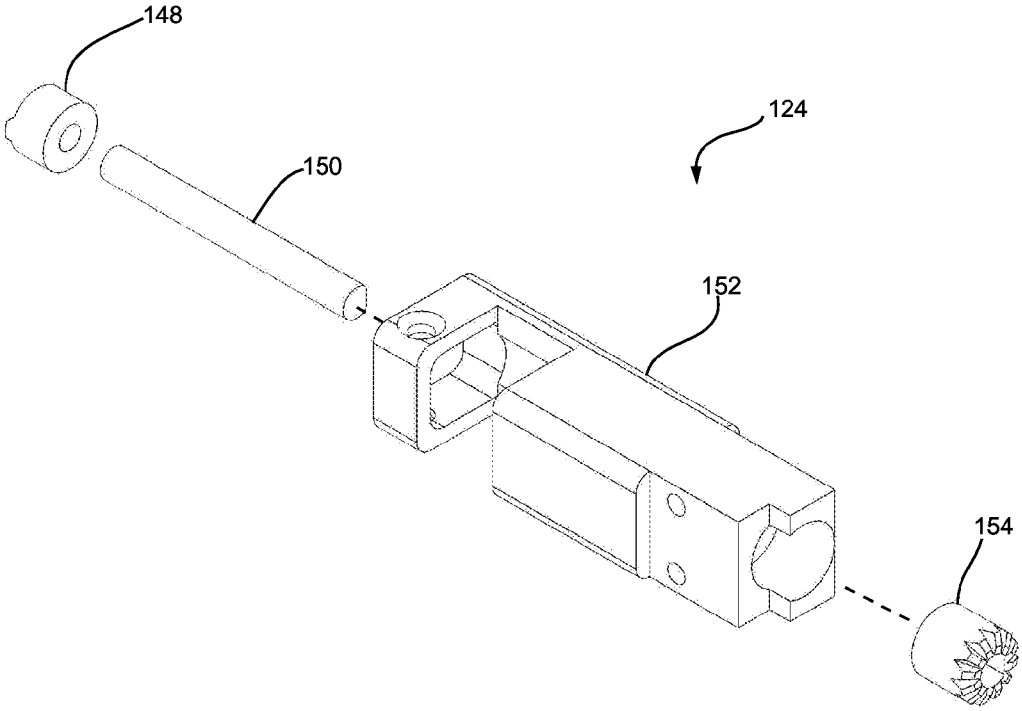
FIG. 5 shows an exploded perspective view of inner arm component, according to one present arrangement, of the exemplar arm sub-assembly of FIG. 2.
Figure 6:
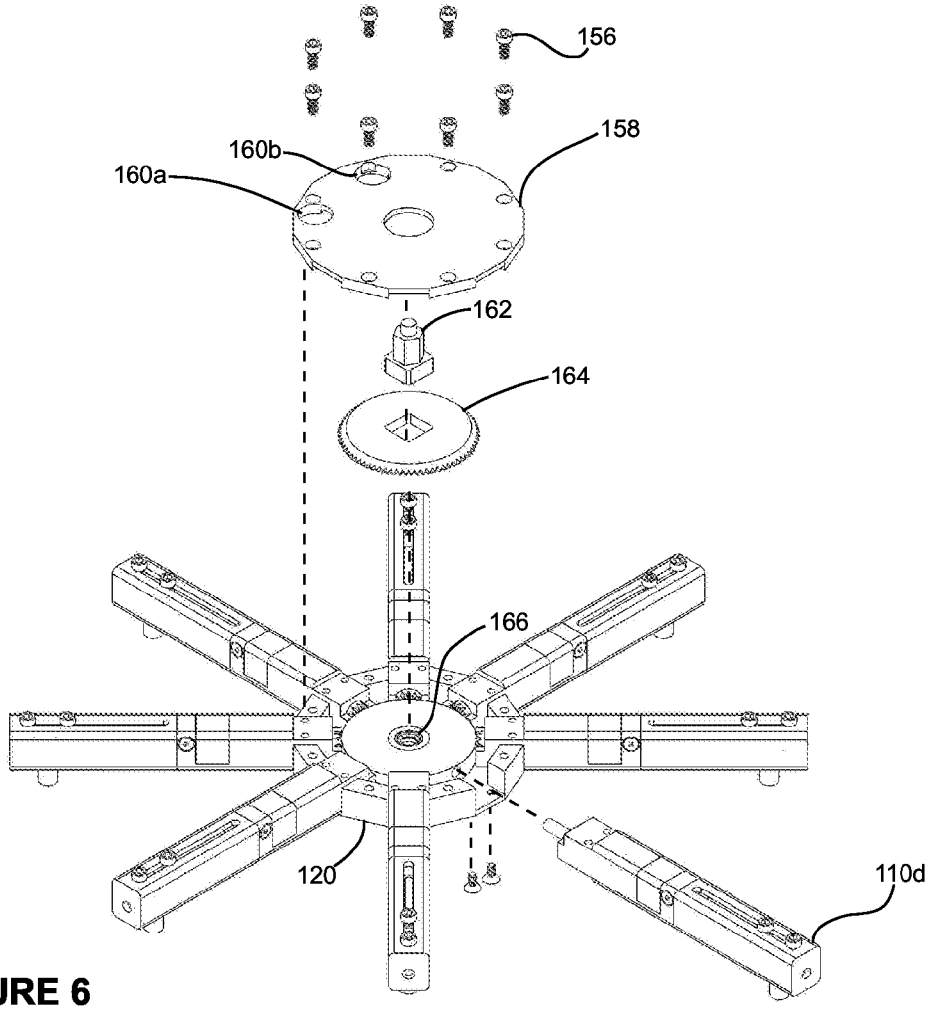
FIG. 6 shows a partially exploded perspective view of the hub and an exemplar arm sub-assembly shown in FIG. 1.

FIG. 5 shows a detailed view of inner arm component 124. According to this figure, inner arm component includes a male clutch component 148, an inner arm shaft 150, an inner arm housing 152 and an inner arm gear 154. Inner arm shaft 150 at one end passed through inner arm housing 152 and couples to an inner arm gear 154. Inner arm housing 152 may be fabricated using any method, including those mentioned as exemplar methods for manufacturing outer arm housing 112. As mentioned above, inner arm gear 154 meshes with a hub gear (e.g., see hub gear 164 of FIG. 6). In this meshing configuration, a torque induced at the hub gear is transferred through inner arm gear 154 to inner arm shaft.

Inner arm shaft 150 at a distal end couples with a male clutch component 148. Male clutch component 148 shown in FIG. 5 and female clutch component 136 of FIG. 3 are in designed to mate with each other such that during an operational state of the present drum tuners, torque is transferred from male clutch component 148 of FIG. 5 to female clutch component 136 of FIG. 3. As mentioned before, the configuration of outer arm component 112 transfers torque from female component 136 to differential gear 145. Consequently, torque induced at a hub gear is transferred from inner arm component 124 and outer arm component 112 and eventually down to differential gear 145 that engages with a drum's tuning mechanism during a tuning operation.

As torque is being transferred from the hub gear to two or more differential gears during a tuning operation, the drum's tuning mechanism begins to progressively tighten a drumhead around the drums periphery. An increasing amount of tension particularly develops near a location where the drum's tuning mechanism tightens the drumhead. As tuning proceeds, a corresponding potential energy storage component 132 (participating in activating the drum's tuning mechanism) continues to store potential energy. In those instances where potential energy storage component is a spring, the spring is compressed between stopper 114 and bushing 134 as tuning proceeds. When a portion of the drumhead's tension equals or exceeds the potential energy stored in the corresponding potential energy storage component 132 of FIG. 3, then stopper 114 applies sufficient amount of force on female clutch component 136 such that female clutch component 136 and male clutch component 148 of FIG. 5 cease to mate. In this configuration, torque is no longer transferred from inner arm component 124 of FIG. 5 to outer arm component 112 of FIG. 3. Consequently, a corresponding differential gear 145, which is engaged with the drum's tuning mechanism, deactivates the tuning process. Thus, female clutch component 136 of FIG. 3 and male clutch component 148 of FIG. 5 serve to make sure that a particular region of a drumhead is placed under a requisite amount of tension as the tuning process for that region concludes. In this manner, stopper 114 at each of arm sub-assemblies 110*a*-110*h* may be set and/or potential energy storage component 132 of FIG. 3 capable of storing an appropriate amount of potential energy may be used to arrive at the appropriate amount of tension at the various drumhead locations that are being tuned by the various arm sub-assemblies.

FIG. 6 shows the manner in which an exemplar arm assembly 110*d* is connected to hub component 120. According to FIG. 6, hub component 120 includes chassis that locates and secures each arm assembly. A hub gear 164 may have an aperture defined therein and through which a hub shaft 162 passes and is secured inside a bearing 166 of hub component 120. A hub cover 158 preferably covers hub gear 164 and may have defined therein two apertures 160*a* and 160*b* that facilitate securing of hub cover 158. Other apertures defined in hub cover 158 may facilitate fastening of the hub cover to secure, among other things, hub gear 164 in place.

Figure 8:
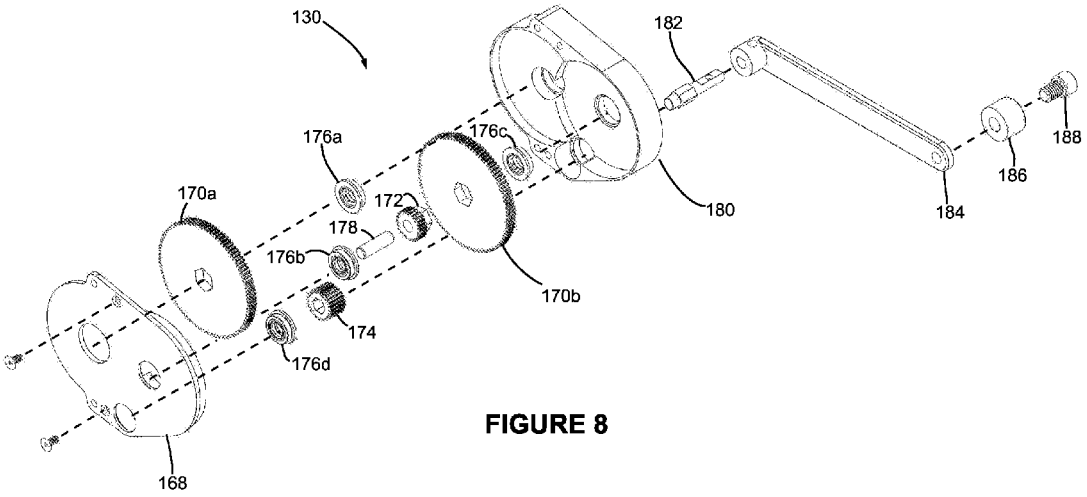
FIG. 8 depicts an exploded perspective view of the crank assembly, in accordance with one present teaching, that may be coupled to the hub.

FIG. 8 clearly shows a meshing arrangement between hub gear 164 and inner arm gear 154. In this figure, hub shaft 162 and bearing 166 are shown in their assembled state proximate hub gear 164.

Figure 7:
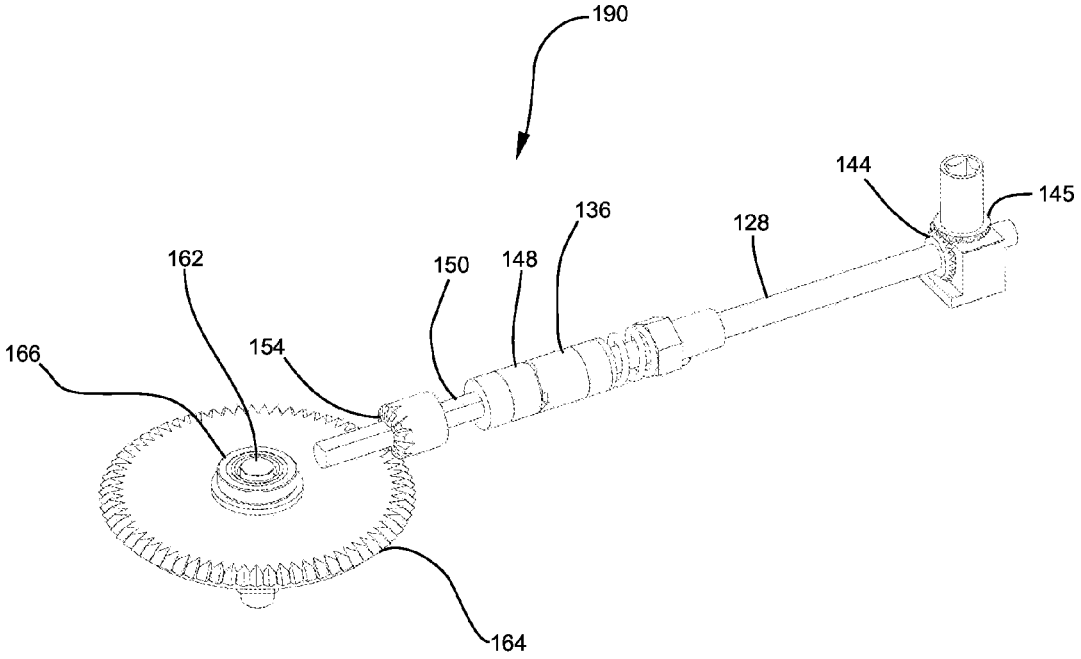
FIG. 7 shows a gear train, according to one present teaching, that is found inside drum tuner of FIG. 1.

FIG. 7 shows one present arrangement of a gear train 190 that includes hub gear 164 meshing with inner arm gear 154, which is coupled to inner arm shaft 150. According to this figure, male clutch component, which is coupled to inner arm shaft 150, is capable of engaging with female clutch component 136 that couples to outer arm shaft 128. Furthermore, an outer arm gear 144, which is coupled to outer arm shaft 128, meshes with a differential gear 145. The arrangement of FIG. 7 shows, among other things, how torque introduced at hub gear 164 results in rotation of differential gear 145.

Torque may be introduced at hub gear 164 of FIG. 7 in a variety of number ways. One exemplar means is disclosed in FIG. 8. According to this figure, a crank sub-assembly 130 induces torque with the help of a crank handle 186, which may be manually or automatically operated. A screw 188 or a fastening assembly secure crank handle 186 to a crank arm 184, which in turn connects at its distal end to a crankshaft 182 that passes through a crank chassis 180. A crank cover 168 is fastened to crank chassis by one or more screws securing therein the various components of crank sub-assembly 130. Examples of such components include bearings 176*a*-*d*, a first crank gear 170*b*, a second crank gear 170*a*, a gear pin 178 and a crank pinion 174. According to the configuration shown in FIG. 8, crankshaft 182 slides into and interlocks with crank pinion 174, which meshes with first crank gear 170*b*. Rotation of crankshaft 182 rotates crank pinion 174, which in turn rotates first crank gear 170*b*. First crank gear 170*b* may have defined therein an aperture. A first stage gear 172 occupies the aperture of first crank gear 170*b* and thereby interlocks with it. As shown in FIG. 8, stage gear 172, in turn, may have an aperture defined therein. A gear pin 178 passes through the apertures of stage gear 172 and a bearing 176*b* so that it may be secured to crank cover 168. Continuing with the exemplar configuration of FIG. 8, a torque present at crank gear 170*b* is transferred to stage gear 172 and rotates second crank gear 170*a* because stage gear 172 and second crank gear 170*a* are in a meshing arrangement. An aperture defined inside a central portion of second crank gear 170*a* may be designed to receive a shaft (e, g, hub shaft 162 of FIG. 6) such that rotation of second crank gear 170*a* induces torque at hub gear 164 of FIG. 6.

As a result, FIG. 8, teaches, among other things, generating torque at a single point and then transferring that torque to various drum tuning mechanisms. This is typically done after multiple differential units are engaged with a drum's tuning mechanism. In this embodiment the crank handle 186 is connected to the crank arm 184, which acts to rotate crankshaft 182 providing a means to use the drum tuner manually with a lever.

Although crank chassis 180, which locates crank gears 170*a* and 170*b*, crank pinion 174 and a stage gear 172, is a machined aluminum in the embodiment of FIG. 8, it is not necessarily so limited. Crank chassis 180 may be manufactured as an injection molded polymer or a die-cast aluminum. In this embodiment crankshaft 180 preferably engages with crank pinion 174 along rotational fixity in order to transmit torque. Crank pinion 174 may drive crank gear 170*b*, and stage gear 172, which is secured to 170*b* such that they rotate together. This may be thought of as the second stage in torque transmission, as the first stage is between the crankshaft 180 and crank gear 170*b*. As explained above, crank gear 170*b* may be secured axially with gear pin 178 and may then interface with bearings 170*b* and 170*c*. In this embodiment, bearings 170*b* and 170*d* protrude past the top surface of crank cover 168. This may serve as an additional location means between hub 120 of FIGS. 1 and 10 and crank assembly 130 of FIGS. 1 and 10.

Bearing 170*b* preferably engages with an aperture 160*a* defined in hub cover 158 of FIG. 6. Similarly, bearing 170*d* locates with aperture 160*b* defined in hub cover 158 of FIG. 6. Stage gear 172 may drive crank gear 170*a*, which may in turn, positively engage with hub shaft 162 of FIG. 6, such that when crank gear 170*a* rotates hub shaft 162 rotates as well. Bearing 176*a* acts to locate hub shaft 162 translationally while allowing rotation. The crank assembly is preferably secured in place with crank cover 168 that is designed to enclose the transmission components and prevent ingress of foreign material. In the embodiment of FIG. 8, crank cover 168 is more preferably secured to crank chassis 180 using socket head flat fasteners, as it is preferable to have the top surface of crank cover 168 flush with the exception of any location features. It is also possible to drive crank assembly 130 with means other than by hand, such as a motor, or screw gun. Further more it is possible for the invention to work without the crank assembly and use other means of transmission such as pulleys, or electric motor.

Figure 9:
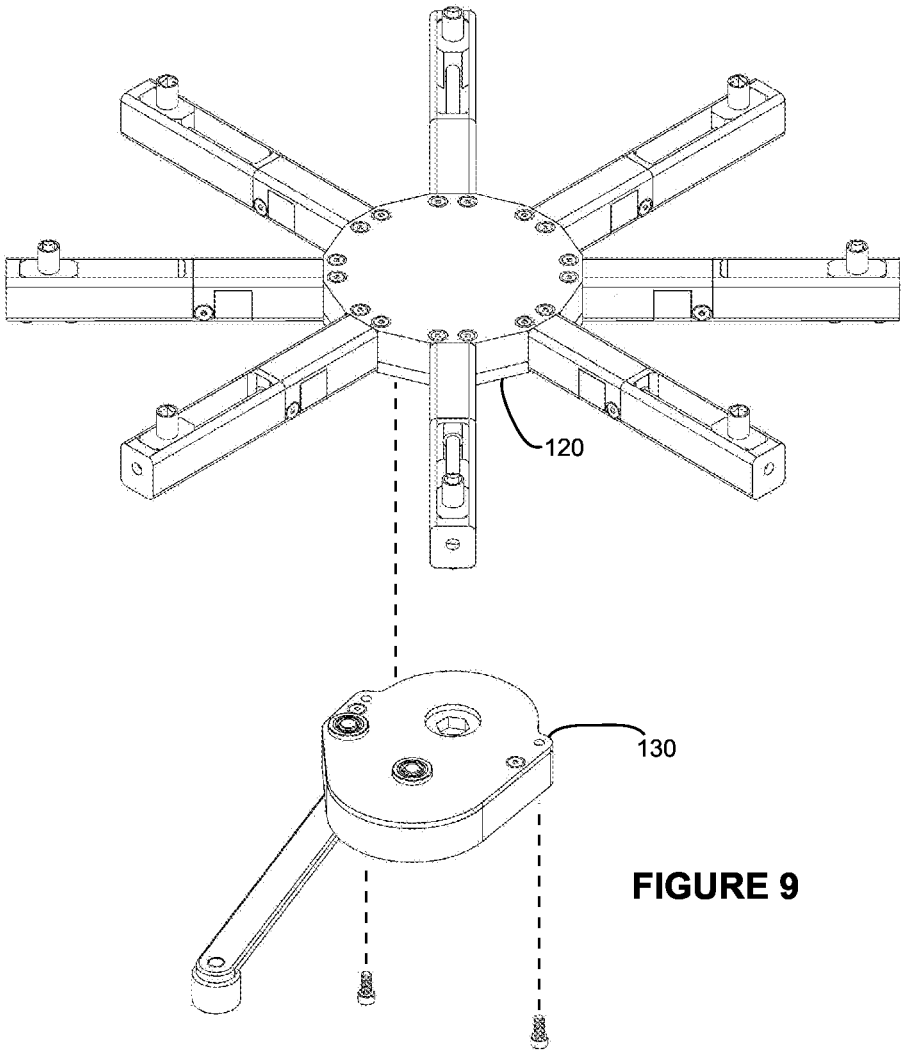
FIG. 9 shows a partially exploded perspective bottom view of the drum tuner shown in FIG. 1.

FIG. 9 shows a bottom view of a crank sub-assembly 130 that is coupled to a hub component 120, which has radially disposed around it arm sub-assemblies. In this embodiment the inner shaft is received in a bushing inside of the hub that allows for rotation but secures translation of each inner shaft. To this end, reference may be made to FIG. 5 to facilitate discussion. A transmission is made through the hub gear 164, which is preferably beveled and engages with each arm assemblies' inner gear. Bearing 166 is shown in FIG. 5 inside the hub's center axis and may act to locate and secure hub shaft 162 while allowing it to rotate. As shown in FIG. 5, hub shaft 162 is preferably secured such that hub shaft 162 positively engages hub gear 164 in rotation. Hub 120 (of FIGS. 1 and 10) is covered with hub cover 158 (of FIG. 5), which also act to further secure the arm assemblies as well as the hub shaft and hub gear along their axis. Although the embodiment of FIG. 9 shows crank assembly 130 secured to hub 120 using socket head cap screws, it could be secured by any number of other mechanical means, such as pins, snaps, interference, adhesive, hinges, slides, taper and luer.

According to the present teachings a process of tuning a drum is also described. In one embodiment, the process includes engaging two or more tuning mechanisms of a drum (e.g., two or more lugs of a drum) with a housing component of two or more differential gears (e.g., differential gears 142 and housing portion 143 of FIG. 3). In an assembled state of the various inventive drum tuners, an exemplar of which is shown by FIGS. 2, 3, 4 and 5, differential gears 142 of FIG. 3 are communicatively coupled to hub gear 164 of FIG. 6.

In the above-described engaged configuration, a next step of inducing torque at the hub gear (e.g., hub gear 164 of FIG. 6) may be performed. Then, a step of transferring torque at the hub gear to two or more of the differential gears is carried out.

In certain preferred embodiments, the tuning process described above may further include producing potential energy proximate to a first location associated with one of the two or more differential gears during the step of transferring torque. A next step may include storing the potential energy at the first proximate location associated with one of the two or more differential gears. Then a step of ceasing transfer of torque from the hub gear to one of the two or more differential gears is carried out when the potential energy stored at the first proximate location associated with one of the two or more differential gears reaches or exceeds a predetermined potential energy value.

In certain embodiments, a step of continuing inducement of torque at the hub gear is carried out, after the step of ceasing transfer of torque from the hub gear to one of the two or more differential gears is performed, until the potential energy produced at a second proximate location associated with another of the two or more differential gears reaches or exceeds the predetermined potential energy value.

In certain other embodiments, a step of continuing inducement of torque at the hub gear is carried out, after the step of ceasing transfer of torque from the hub gear to one of the two or more differential gears, until the potential energy produced at each proximate location associated with each of the two or more differential gears reaches or exceeds the predetermined potential energy value. In one embodiment of the present tuning process, the torque at two or more of the differential gears may be clockwise.

Similarly, the present teachings provide a process of removing a drumhead. An exemplar drumhead removal process includes the above-described engaging step, i.e., engaging two or more tuning mechanisms of a drum with two or more differential gears that are communicatively coupled to a hub gear. Then, a step of inducing torque at the hub gear is carried out. Next, a step of transferring torque at the hub gear to two or more of the differential gears is performed. In this drumhead removal process, the torque at two or more of the differential gears may be counter-clockwise. Regardless of the direction of torque, continued application of torque at two or more differential gears rotates the drum's tuning mechanism until the drumhead is unfastened to the drum's periphery. In other words, the drumhead is no longer being held around the drum's periphery by the drum's tuning mechanism.

What is claimed is:

1. A drum tuner comprising:

a hub gear;

two or more differential gears communicatively coupled to said hub gear and at least one of said two or more differential gears capable of engaging a tuning mechanism of a drum; and wherein, during an operational state of said drum tuner, rotation of said hub gear rotates at least one of said two or more differential gears to activate said drum's tuning mechanism.

2. The drum tuner of claim 1, wherein said hub gear is driven by a crank sub-assembly.

3. The drum tuner of claim 2, wherein said crank sub-assembly includes:

at least two crank gears;

a stage gear having a portion coupled to one of said at least two crank gears such that a rotation of said one of said at least two crank gears rotates said stage gear;

a crank pinion meshing with another of at least two of the crank gears such that rotation of the crank pinion rotates another of at least two of the crank gears that is coupled to a hub shaft; and wherein another of said at least two crank gears is coupled to a hub shaft that is in turn coupled to said hub gear such that rotation of another of said at least two crank gears through said hub shaft rotates said hub gear and said crank pinion is coupled to a crank shaft, which is capable of rotation by an external force.

4. The drum tuner of claim 3, wherein said stage gear interlocks with said one of said at least two crank gears.

5. The drum tuner of claim 1, wherein said external force includes action of an electrical motor or manual rotation of said crank shaft using a handle.

6. The drum tuner of claim 1, wherein at least one of said two or more differential gears is secured inside a tuning yoke that is capable of lateral displacement along an arm sub-assembly so that said drum tuner is capable of tuning a plurality of drums of different sizes.

7. The drum tuner of claim 1, further comprising two or more arm sub-assemblies, and at least one of said two or more arm sub-assemblies disposed between said hub gear and at least one of said two or more differential gears, wherein, during an operational state of said drum tuner, rotation of said hub gear rotates at least one of said two or more arm sub-assemblies, which in turn rotates at least one of said two or more differential gears.

8. The drum tuner of claim 7, wherein a number of said two or more arm sub-assemblies ranges from 2 to 20.

9. The drum tuner of claim 1, wherein at least one of said two or more arm sub-assemblies includes an inner arm component and an outer arm component and a clutch mechanism connects said inner arm component and said outer arm component such that rotation in a first direction of said inner arm component rotates said outer arm component until a predetermined potential energy value is achieved at said clutch mechanism, and when rotational displacement in said first direction of said inner arm component exceeds said predetermined potential energy value at said clutch mechanism, rotation of said outer arm component ceases.

10. The drum tuner of claim 9, wherein displacement in a second direction of said inner arm component rotates said outer arm component and said second direction is opposite to said first direction.

11. The drum tuner of claim 10, wherein said first direction is a clockwise direction and said second direction is a counter-clockwise direction.

12. The drum tuner of claim 7, wherein at least one of said two or more arm sub-assemblies includes an arm gear that is meshed with said differential gear such that rotation of said arm gear rotates said differential gear.

13. The drum tuner of claim 12, wherein said arm gear is a beveled gear.

14. A clutch mechanism of a drum tuner, said clutch mechanism comprising:

a female clutch component;

a male clutch component capable of engaging with said female clutch component;

a shaft designed to transfer torque at said female clutch component to a differential gear capable of engaging with a drum's tuning mechanism;

a disengaging mechanism that is designed to cause said male clutch component to disengage with said female clutch component when a predetermined potential energy value is achieved at said disengaging mechanism; and wherein said predetermined potential energy value is reached at said disengaging mechanism after repeated rotation in a first direction of said male clutch component and said female clutch component.

15. The clutch mechanism of claim 14, wherein at least a portion of said male clutch component engages with a portion of said female clutch component at an angle that ranges from about 35° to about 50°.

16. The clutch mechanism of claim 15, wherein at least a portion of said male clutch component engages with a portion of said female clutch component at an angle of about 45°.

17. The clutch mechanism of claim 14, wherein said disengaging mechanism includes a spring and a stopper, and wherein said spring stores potential energy produced from rotation of said female clutch component and when potential energy stored inside said spring reaches said predetermined potential energy value, then said stopper prevents rotation of said female clutch component in response to rotation of said male clutch component.

18. The clutch mechanism of claim 17, wherein said stopper is a nut.

19. The clutch mechanism of claim 14, wherein said first direction is a clockwise direction.

20. A process of tuning a drum, said process comprising:

engaging two or more tuning mechanisms of said drum with two or more differential gears that are communicatively coupled to a hub gear;

inducing torque at said hub gear; and transferring torque at said hub gear to said two or more differential gears.

21. The process of tuning said drum of claim 20, further comprising:

producing potential energy proximate to a first location associated with one of said two or more differential gears during said transferring torque;

storing potential energy at said first proximate location associated with one of said two or more differential gears; and ceasing transfer of torque from said hub gear to said one of said two or more differential gears when potential energy stored at said first proximate location associated with said one of said two or more differential gears reaches or exceeds a predetermined potential energy value.

22. The process of tuning of said drum of claim 21, further comprising continuing inducement of torque at said hub gear after said ceasing transfer of torque from said hub gear to said one of said two or more differential gears until potential energy produced at a second proximate location associated with another of said two or more differential gears reaches or exceeds said predetermined potential energy value.

23. The process of tuning of said drum of claim 21, further comprising continuing inducement of torque at said hub gear after said ceasing transfer of torque from said hub gear to said one of said two or more differential gears until potential energy produced at each proximate location associated with each of said two or more differential gears reaches or exceeds said predetermined potential energy value.

24. The process of tuning said drum of claim 20, wherein said torque at said two or more differential gears is clockwise.

25. A process of removing a drumhead, said process comprising:

engaging two or more tuning mechanisms of said drum with two or more differential gears that are communicatively coupled to a hub gear;

inducing torque at said hub gear; and transferring torque at said hub gear to said two or more differential gears.

26. The process of removing said drumhead of claim 25, wherein said torque at said two or more differential gears is counter-clockwise.

27. The process of removing said drumhead of claim 25, wherein at least one of said two or more differential gears is magnetic.

* * * * *